US009586227B2

(12) United States Patent
McAdams

(10) Patent No.: US 9,586,227 B2
(45) Date of Patent: Mar. 7, 2017

(54) SPRAY GUN EXTENSION APPARATUS

(71) Applicant: Floyd Charles McAdams, Semmes, AL (US)

(72) Inventor: Floyd Charles McAdams, Semmes, AL (US)

( * ) Notice: Subject to any disclaimer, the term of this patent is extended or adjusted under 35 U.S.C. 154(b) by 92 days.

(21) Appl. No.: 14/526,043

(22) Filed: Oct. 28, 2014

(65) Prior Publication Data

US 2016/0114346 A1 Apr. 28, 2016

(51) Int. Cl.

| | |
|---|---|
| ***B05B 17/00*** | (2006.01) |
| ***B05B 15/06*** | (2006.01) |
| ***B05B 7/24*** | (2006.01) |
| ***B05B 12/00*** | (2006.01) |
| ***B05B 9/08*** | (2006.01) |

(52) U.S. Cl.

CPC ..... *B05B 15/066* (2013.01); *B05B 7/2402* (2013.01); *B05B 9/08* (2013.01); *B05B 12/00* (2013.01); *B05B 12/002* (2013.01); *B05B 15/061* (2013.01); *B05B 15/064* (2013.01); *B05B 15/068* (2013.01)

(58) Field of Classification Search

CPC ... B05B 15/066; B05B 15/061; B05B 15/064; B05B 15/068; B05B 12/00; B05B 12/002; B05B 7/2402; B05B 9/08

USPC ... 239/1, 152, 154, 280, 281, 525, 526, 532, 239/578, 587.1, 587.4, 587.5; 222/174; 251/294

See application file for complete search history.

(56) References Cited

U.S. PATENT DOCUMENTS

| | | | | | |
|---|---|---|---|---|---|
| 1,728,455 | A | * | 9/1929 | Taylor | B05B 1/1609 239/578 |
| 1,745,972 | A | * | 2/1930 | Beck | B05B 15/064 239/532 |
| 2,857,201 | A | * | 10/1958 | Palmer | A01M 7/006 239/281 |
| 3,915,382 | A | | 10/1975 | Davis | |
| 3,940,072 | A | | 2/1976 | Ishikawa | |
| 4,023,711 | A | * | 5/1977 | Sena | B05B 15/064 222/174 |
| 4,323,196 | A | | 4/1982 | Logue | |
| 4,457,472 | A | * | 7/1984 | Geberth, Jr. | B05B 15/064 239/281 |
| 5,236,129 | A | * | 8/1993 | Grime | B05B 7/0081 239/526 |
| 6,070,809 | A | * | 6/2000 | Price | B05B 15/061 239/526 |

(Continued)

FOREIGN PATENT DOCUMENTS

GB 2392118 B 2/2004

*Primary Examiner* — Steven J Ganey

(74) *Attorney, Agent, or Firm* — AdamsIP, LLC; J. Hunter Adams; Stephen Thompson

(57) ABSTRACT

A preferred implementation of the invention is a spray gun extension apparatus comprising a stock and a handle. In a preferred implementation the handle is a twist-style throttle handle. The invention further comprises a trigger capable of activating a spray gun. In one embodiment the trigger is connected to the handle. In yet another embodiment the trigger is connected to the stock. A rod is connected to a first rod bearing and a second rod bearing. These rod bearings are commonly known as heim joints. Further disclosed herein is a method of using a throttle-style spray gun extension apparatus.

12 Claims, 2 Drawing Sheets

(56) References Cited

U.S. PATENT DOCUMENTS

| | | | | |
|---|---|---|---|---|
| 6,378,922 | B1 | 4/2002 | Troudt | |
| 6,419,165 | B1 | 7/2002 | Schroeder | |
| 6,540,163 | B1 | 4/2003 | Huang | |
| 6,547,165 | B2 | 4/2003 | Goodwin | |
| 6,685,115 | B1 | 2/2004 | Hardin | |
| 6,976,644 | B2 * | 12/2005 | Troudt | B05B 15/066 239/578 |
| 7,455,469 | B1 | 11/2008 | Langdon | |
| 7,533,485 | B2 | 5/2009 | Nyland | |
| 8,708,254 | B2 | 4/2014 | Baxter | |
| 2007/0122227 | A1 | 5/2007 | Davis | |
| 2011/0180626 | A1 | 7/2011 | Kang | |
| 2012/0012677 | A1 * | 1/2012 | Crossley, III | B05B 9/01 239/526 |

* cited by examiner

SPRAY GUN EXTENSION APPARATUS

FIELD OF THE INVENTION

The present invention refers generally to a paint spray gun apparatus, and more specifically to a paint spray gun extender allowing a painter to attach readily available spray guns to the extender for painting various surfaces.

BACKGROUND

Spray painting is a painting technique where a device sprays a coating (paint, ink, varnish, etc.) through the air onto a surface. The most common types employ compressed gas—usually air—to atomize and direct the paint particles. Air gun spraying is typically used for covering large surfaces with an even coating of liquid. Spray guns can be either automated or hand-held and have interchangeable heads to allow for different spray patterns.

To spray paint with a gun, the spray gun must be in motion as it commences across the surface to be painted. As you pull the trigger on some spray guns, the first projection will be air followed by paint. The goal is to feather the paint onto the surface as you start spraying the surface and then to feather the paint off the surface as you complete the arc with your arm. A painter should hold his wrist firmly so the spray gun always remains at right angles to the surface. The heaviest paint concentration is usually in the center of the spray pattern and the edges of the pattern feather out. As a painter goes back and forth across the surface he should lap these feathered edges so the paint will be the same thickness throughout.

There are many techniques for using a spray gun. Generally, the painter uses a swaying back and forth motion to spray the paint onto the surface. While this is generally the best approach for applying an even spray to the surface, a painter must work in small areas to keep an even coating. One reason a painter must work in a small area is because the layer of paint is greater as the painter sways the paint gun directly in front of his body and is less thick when he sways to the side. This is based in large part on the angle in which the spray gun is aimed at the target surface. If a painter attempts to cover a large area at one time he will have a very thick layer of paint directly in front of him (when the spray gun is at 90 degrees) and will have a much thinner layer as the spray gun becomes more angled in relation to the target surface.

Ideally, as the painter sprays he will keep the nozzle about a foot or less away from the surface and will direct the nozzle of the gun at a 90-degree angle to the vertical surface. It is important for even coverage that a painter keeps the spray gun as square to the surface as possible. Generally, a painter must twist his wrist in just the right amount to keep the spray gun angle correct. This is a skill that takes time and experience to grasp.

In addition to holding s spray gun, it is also common for painters to use spray gun extenders. There are different types of spray gun extenders, and all of them exacerbate the problem of uneven spraying because extenders increase the swaying range of motion, and thus the angle at which the painter directs the paint to the target surface during each back and forth motion. Therefore, there is a need in the art for a paint gun extender allowing a painter to direct the paint gun head as he moves in a swaying back and forth motion. Furthermore, there is a need in the art for a paint gun extender that allows a painter to twist his wrist in order to twist the spray gun head. Additionally, there is a need in the art for a spray paint gun extender allowing the painter to easily change the spray gun angle in relation to the target surface as he moves in a back and forth motion.

SUMMARY

A preferred embodiment of the invention is directed generally to a spray paint gun extender allowing a user to easily change the spray gun angle in relation to the target surface as he moves in a back and forth motion. A preferred implementation of the invention is a spray gun extension apparatus comprising a stock and a handle. In a preferred implementation the handle is a twist-style throttle handle. The invention further comprises a trigger capable of activating a spray gun. In one embodiment the trigger is connected to the handle. In yet another embodiment the trigger is connected to the stock. A rod is connected to a first rod bearing and a second rod bearing. These rod bearings are commonly known as heim joints.

The first rod bearing is connected to the handle. The second rod bearing is connected to a spray gun attachment element. The spray gun attachment element as set forth herein is understood to be any mechanism for attaching the spray gun to the end of the spray gun extender. In one embodiment the spray gun extender comprises a quick-release attachment element allowing a user to quickly attach a spray gun to the extender. This quick release may comprise a simple pin or clamp configuration.

Other embodiments of the invention further comprise the attachment element having a hinge for allowing the spray gun to move in an up and down fashion. A preferred embodiment of the apparatus comprises an attachment element having a hinge that has a plurality of fixed positions. In this way the user may position a spray gun to be directed at a certain angle in the vertical direction, but will still allow the user to change the angle of the spray gun in the horizontal direction.

In a preferred implementation the spray gun extension apparatus further comprises support elements attached thereto. These supports elements may be a wrist support, forearm support, or both.

In order for the apparatus trigger to activate the spray gun trigger, a preferred implementation of the invention further comprises a wire having a first end and a second end. The first end of the wire is connected to the trigger. The second end of the wire is connected to the spray gun trigger.

Further disclosed herein is a method for using a spray gun comprising using a spray gun extension apparatus. First, a person uses a spray gun extension apparatus comprising a stock and a handle. The handle is a twist-style throttle handle. The apparatus further comprises a trigger connected to the handle. The handle has a wire connected thereto having a first end and a second end. The first end of the wire is connected to the trigger. The second end of the wire is connected to the spray gun trigger. The apparatus further comprises a rod being connected to a first rod bearing and a second rod bearing. The first rod bearing is connected to the handle. The second rod bearing is connected to a spray gun attachment element. The spray gun attachment element is able to articulate in response to forces being exerted on the rod, and in relation to a user's wrist motion.

The person using the extension apparatus connects a commercially available spray gun to the spray gun attachment element. The person connects the wire from the extension apparatus trigger to the spray gun trigger. The person then sways in a back and forth motion and twists his wrist as he paints. In so doing, the user exerts force on the rod, which in turn exerts force on the spray gun. This force causes the spray gun to turn in relation to the person's wrist. Therefore, a person may alter the angle of the spray gun in relation to the surface by twisting his wrist. Just as if the person was holding the spray gun in his hand and using his wrist to alter the angle, similarly the person using the spray gun extension apparatus may twist his wrist to manipulate the spray gun head angle. In this way a user may paint larger surface areas while being able to manipulate the angle of the spray gun head.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two ore more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

It is understood that versions of the invention may come in different forms and embodiments. Additionally, it is understood that one of skill in the art would appreciate these various forms and embodiments as falling within the scope of the invention as disclosed herein.

The invention disclosed herein is a spray gun extender. In the preferred implementation, the paint spray gun extender has a stock. The extender further comprises a handle, trigger, hinge, throttle, rod end bearings (heim joints), and a rod. Embodiments of the present invention further comprise arm supports. For example, implementations of the invention may comprise forearm and/or wrist supports.

In some implementations, the stock of the extender may be adjustable. This feature allows painters of various sizes to comfortably use the apparatus for extended periods of time. In other implementations, the stock of the extender may be foldable. This feature allows the extender to be portable for ease of transport.

Figure 1:
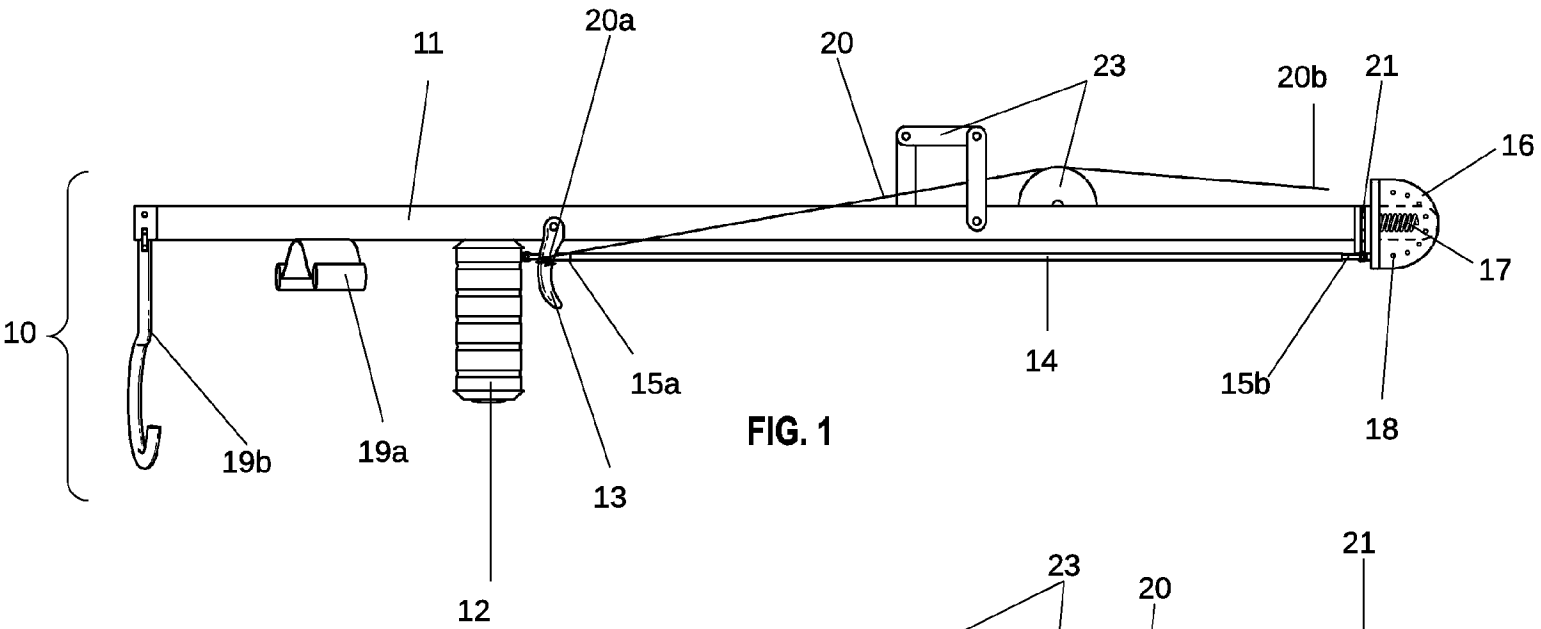
FIG. 1 is a front view of a spray gun extension apparatus disclosed herein.

As illustrated in FIG. 1, a preferred embodiment of the spray gun extension apparatus 10 comprises a stock 11 with a handle 12 connected thereto. The apparatus 10 further comprises a trigger 13 for activating a spray gun and a rod 14 connected to a first rod bearing 15*a* and a second rod bearing 15*b*. The rod bearings 15, commonly known as heim joints, allow for freer rotation when using a twist throttle for the handle 12 to manipulate the rotation of the spray gun. Thus, the first rod bearing 15*a* is connected to the handle 12 and the second rod bearing 15*b* is connected to a spray gun attachment element 16.

Figure 2:
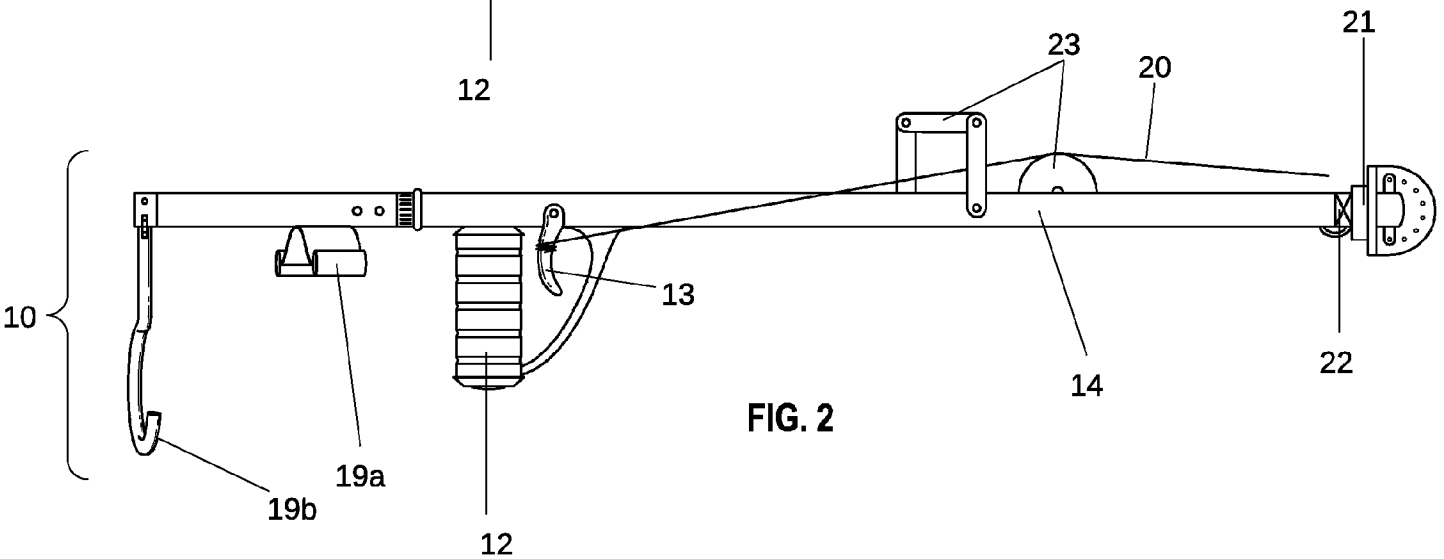
FIG. 2 is a front view of a spray gun extension apparatus disclosed herein.

As set forth in FIG. 1 and FIG. 2, the spray gun attachment element 16 may be spring loaded 17 or may comprise notches 18 for a quick release mechanism. It is understood that the spray gun may attach to the spray gun attachment element 17 by a quick release pin, a clasp, adhesive, straps, or a locking mechanism designed to accept a spray gun into the attachment element.

As illustrated in the figures, the preferred embodiment of the apparatus 10 comprises the handle 12 being a twist throttle. In one embodiment the throttle 12 is a motorcycle-type twist throttle. However, it is understood that any form of twisting handle may be used for this application.

In many instances a painter will use the apparatus 10 disclosed herein for extended periods of time. Therefore, as illustrated in FIG. 1 and FIG. 2, a preferred embodiment of a version of the invention comprises the stock 11 having support elements 19 connected thereto. The support elements 19 may be placed to support a user's wrist 19*a* and forearm 19*b*.

Additionally, a preferred embodiment of the apparatus 10 comprises a wire 20 for connecting the apparatus trigger 13 to a trigger of an attached spray gun. Therefore, the apparatus 10 further comprises a wire 20 with a first end 20*a* and a second end 20*b*. The first end of the wire 20*a* is connected to the trigger 13. The second end of the wire 20*b* is connected to a spray gun trigger.

Figure 3:
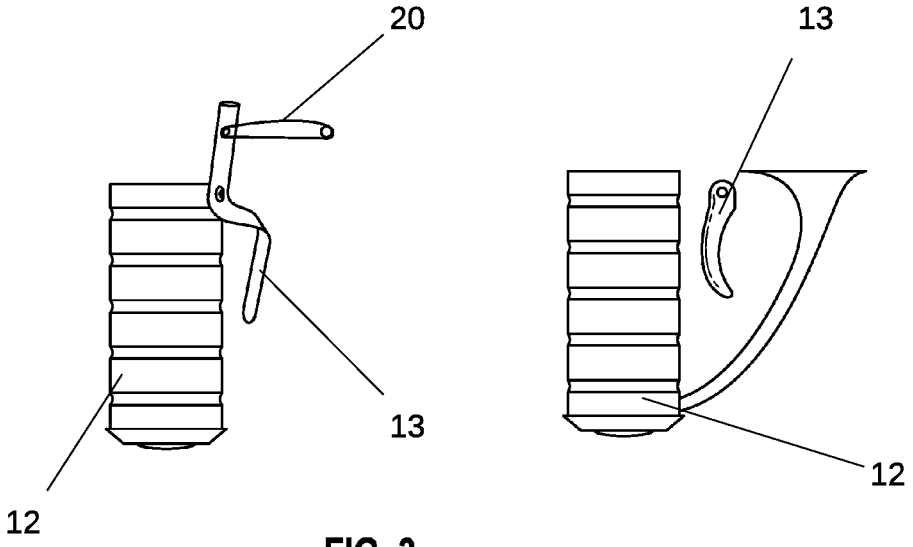
FIG. 3 is a front view of two implementations of the handle and trigger set-up consistent with the spray gun extension apparatus disclosed herein.

In a preferred embodiment, the spray gun extension apparatus trigger 13 is connected to the twist throttle 12. In this way the apparatus trigger 13 is fixed to the throttle 12 such that twisting the throttle 12 also twists the trigger 13 in relation to the throttle 12. Yet another embodiment of a version of the invention comprises the apparatus trigger 13 being connected to the stock 11 such that twisting the throttle 12 does not twist the trigger 13 in relation to the throttle 12. The difference in the two embodiments is further illustrated in FIG. 3. FIG. 3 shows two separate examples of a possible configuration. In one configuration the trigger 13 is attached to the handle 12 and the wire 20 is attached to the top section of the trigger 13. In another configuration the trigger 13 is not attached to the handle 12.

As illustrated in FIG. 2, one embodiment comprises the spray gun extension apparatus 10 being configured such that the rod and rod bearings connecting the handle to the spray gun attachment element are housed in the interior of the stock 11.

An embodiment of a version of the invention further comprises a spray gun extension apparatus 10 having a stock 11, a handle connected to the stock 12, a trigger for activating a spray gun 13, a rod 14 connected to a first rod bearing 15*a* and a second rod bearing 15*b*, a first rod bearing 15*a* being connected to the handle 12, the second rod bearing 15*b* being connected to a spray gun attachment element 16, a wire 20 with a first end 20*a* and a second end 20*b*, the first end of the wire 20*a* being connected to the apparatus trigger 13, and the second end of the wire 20*b* being connected to a spray gun trigger.

Figure 4:
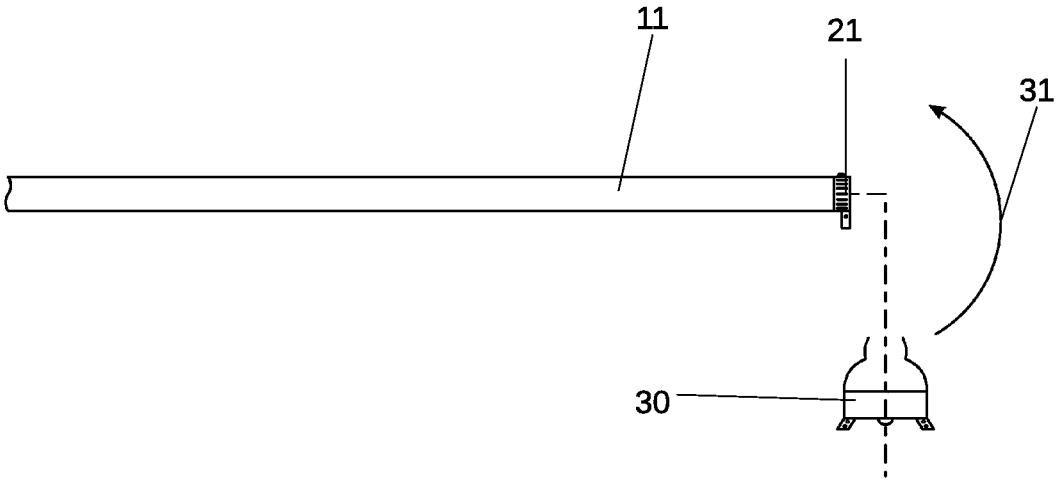
FIG. 4 is a top plan view of a spray gun extension apparatus disclosed herein.

As illustrated in FIG. 1 and FIG. 4, the stock 11 and spray gun attachment element 16 are connected at a joint 21 that allows the spray gun 30 to articulate in a horizontal direction 31. As further illustrated in FIG. 2, a hinge 22 may also allow the spray gun to articulate in a vertical direction. Said stock 11 and said spray gun attachment element 16 are connected with a hinge 22. The hinge 22 may also allow a spray gun to be angled at a predetermined angle.

For convenience and ease of travel, the spray gun extension apparatus may comprise a folding stock having an adjustable length.

Additionally, the spray gun extension apparatus 10 may comprise a stock 11 having a wire guide 23 connected thereto. The wire guide 23 guides the wire 20 attaching the apparatus trigger 13 to the spray gun trigger.

The process of using a twist-throttle 12 spray gun extension apparatus 10 begins with a painter using the correct extension apparatus 10. As set forth herein, a painter should use a spray gun extension apparatus 10 having, a stock 11, a twist throttle handle 12 connected to stock 11, a trigger 13 for activating a spray gun, a rod 14 connected to a first rod bearing 15*a* and a second rod bearing 15*b*, the first rod bearing 15*a* being connected to the trigger 13, the second rod bearing 15*b* being connected to a spray gun attachment element 16. There should also be a wire 20 with a first end 20*a* and a second end 20*b*. The first end of the wire 20*a* is connected to the trigger 13. The second end of the wire 20*b* is connected to a spray gun. The stock 11 and the spray gun attachment element 16 is connected at a joint 21 that allows the spray gun to articulate in a horizontal direction.

Next, a painter attaches a spray gun to the spray gun attachment element 16. It is understood that any spray gun having a trigger may be used for the invention. Various embodiments of the invention comprise a plurality of spray gun attachment elements 16 for securing a spray gun to the spray gun extension apparatus 10 disclosed herein.

Once the spray gun is attached to the spray gun extension apparatus 10 the wire 20 is secured from the apparatus trigger 13 to the spray gun trigger. The painter grips the handle 12 of the spray gun attachment apparatus 11 and pulls the trigger 13. Pulling the trigger 13 of the apparatus will tighten the wire 20 and simultaneously pull the trigger of the spray gun.

The painter then moves his arm in a horizontal swaying motion across his body while rotating the wrist and twisting the handle 12. Rotating the wrist in relation to the swaying motion keeps the spray gun at a nearly ninety-degree angle to the painting surface and results in a smooth and uniform appearance.

What I claim as my invention is:

1. A spray gun extension apparatus comprising:
a stock,
a twist handle connected to the stock,
a trigger for activating a spray gun, wherein the trigger is connected to the twist handle, and
a rod connected to a first rod bearing and to a second rod bearing, wherein the first rod bearing is connected to the twist handle and the second rod bearing is connected to a spray gun attachment element such that twisting the twist handle causes rotation of the spray gun attachment element,
wherein the trigger is fixed to the twist handle such that twisting the twist handle also twists the trigger in relation to the twist handle.

2. The spray gun extension apparatus of claim 1, wherein the stock has arm support elements attached thereto.

3. The spray gun extension apparatus of claim 2, wherein the arm support elements comprise support elements placed to support a user's wrist and forearm.

4. The spray gun extension apparatus of claim 1, further comprising a wire with a first end connected to the trigger and a second end connected to the spray gun.

5. The spray gun extension apparatus of claim 1, wherein the rod and the rod bearings are housed in the interior of the stock.

6. The spray gun extension apparatus of claim 1, wherein the stock and the spray gun attachment element are connected at a joint that allows the spray gun attachment element to articulate in both a horizontal and a vertical direction.

7. A spray gun extension apparatus comprising:
a stock,
a twist handle connected to the stock,
a trigger for activating a spray gun, wherein the trigger is connected to the twist handle,
a rod connected to a first rod bearing and to a second rod bearing, wherein the first rod bearing is connected to the twist handle and the second rod bearing is connected to a spray gun attachment element such that twisting the twist handle causes rotation of the spray gun attachment element, and
a wire with a first end connected to the trigger and a second end connected to the spray gun attached to the spray gun attachment element,
wherein the trigger is fixed to the twist handle such that twisting the twist handle also twists the trigger in relation to the twist handle.

8. The spray gun extension apparatus of claim 7, wherein the stock and the spray gun attachment element are connected at a joint that allows the spray gun to articulate in both a horizontal and a vertical direction.

9. The spray gun extension apparatus of claim 8, wherein the joint allows the spray gun to be angled at a predetermined angle.

10. The spray gun extension apparatus of claim 7, wherein the stock has a wire guide attached thereto for guiding the wire from the trigger to the spray gun.

11. The spray gun extension apparatus of claim 7, wherein the stock is a folding stock having an adjustable length.

12. A method for using a spray gun, said method comprising the steps of:
providing a spray gun extension apparatus comprising:
a stock,
a twist handle connected to the stock,
a trigger for activating the spray gun, wherein the trigger is connected to the twist handle,
a rod connected to a first rod bearing and to a second rod bearing, wherein the first rod bearing is connected to the twist handle and the second rod bearing is connected to a spray gun attachment element such that twisting the twist handle causes rotation of the spray gun attachment element, and
a wire with a first end connected to the trigger and a second end connected to the spray gun, wherein the trigger is fixed to the twist handle such that twisting the twist handle also twists the trigger in relation to the twist handle, and wherein the stock and the spray gun attachment element are connected at a joint that allows the spray gun to articulate in a horizontal direction, attaching the spray gun to the spray gun attachment element, gripping the twist handle of the spray gun extension apparatus, pulling the trigger, and moving a user's arm in a horizontal swaying motion while twisting the twist handle by rotating the user's wrist, thereby keeping the spray gun at an angle of approximately ninety degrees to a painting surface.

* * * * *